US006123440A

United States Patent [19]

Albou

[11] Patent Number: 6,123,440

[45] Date of Patent: Sep. 26, 2000

[54] AUTOMOBILE HEADLIGHT AND OPTICAL UNIT WITH HYPERBOLIC REFLECTOR AND PLANO-CONVEX OR TORIC CONVERGENT LENS

[75] Inventor: Pierre Albou, Paris, France

[73] Assignee: Valeo Vision, Bobigny, France

[21] Appl. No.: 09/205,737

[22] Filed: Dec. 4, 1998

[30] Foreign Application Priority Data

Dec. 5, 1997 [FR] France ..... 97 15395

[51] Int. Cl.[7] ..... B60Q 1/00

[52] U.S. Cl. ..... 362/516; 362/518; 362/522; 362/297; 362/309; 362/328; 362/335; 362/346

[58] Field of Search ..... 362/516, 518, 362/522, 297, 309, 328, 335, 346

[56] References Cited

U.S. PATENT DOCUMENTS

| | | | |
|---|---|---|---|
| 4,345,303 | 8/1982 | Gerard et al. | 362/512 |
| 4,427,286 | 1/1984 | Bosse | 399/221 |
| 4,959,757 | 9/1990 | Nakata | 362/516 |
| 5,190,368 | 3/1993 | Sekiguchi | 362/539 |
| 5,897,196 | 4/1999 | Soskind et al. | 362/516 |

*Primary Examiner*—Sandra O'Shea
*Assistant Examiner*—Ronald E. Delgizzi
*Attorney, Agent, or Firm*—Morgan & Finnegan LLP

[57] ABSTRACT

A lighting device (100) for an automobile has a light source (101), a reflector (102), and a convergent lens (103) positioned in front of the reflector in order to form an illuminating light beam. The reflector is of the hyperbolic type with an internal focus ($F_1$), and an external focus ($F_2$) positioned behind said reflector in a region of the focus of said convergent lens, the light source being placed in a region of the internal focus of said reflector so that the latter forms a virtual light source in the region of the focus of said convergent lens.

18 Claims, 3 Drawing Sheets

AUTOMOBILE HEADLIGHT AND OPTICAL UNIT WITH HYPERBOLIC REFLECTOR AND PLANO-CONVEX OR TORIC CONVERGENT LENS

FIELD OF THE INVENTION

The present invention concerns a lighting device for an automobile, which comprises a light source, a reflector and a convergent lens positioned in front of the reflector in order to form an illuminating light beam.

BACKGROUND OF THE INVENTION

Lighting devices of this type are generally devices which fulfil the dipped headlight or foglight function. Such devices comprise, in a known fashion, a reflector of the elliptical type, with a light source placed in a region of the first internal focus of said reflector, and a convergent lens whose focus is positioned in a region of the second external focus of said reflector.

Generally, in order to fulfil the main-beam function, a lighting device with a parabolic reflector is used which, using a light source placed at its focus, forms a light beam whose rays are for the most part substantially parallel to the axis of the device.

Currently, automobile optical units comprise a lighting device of the elliptical type in order to fulfil the dipped headlight or foglight function and a lighting device of the parabolic type for fulfilling the main-beam function, positioned side by side.

However, because the lighting device of the parabolic type fulfilling the main-beam function does not have a front lens, and because the lighting device of the elliptical type fulfilling the dipped headlight or foglight function has one, such an optical unit has a non-homogeneous external appearance.

In order to attempt to harmonise the external style of these optical units having a first lighting device fulfilling the dipped headlight or foglight function and a second lighting device fulfilling the main-beam function, it would be envisaged using, as a lighting device fulfilling the main-beam function, a lighting device of the elliptical type.

However, the lighting device of the elliptical type would not make it possible to form an efficient main-beam lighting beam.

This is because the value of the intensity formed by this type of lighting device in the axis thereof (the fundamental value for a lighting device fulfilling the main-beam function, insofar as it determines the "peak" of the main-beam light beam formed), is proportional to the apparent surface area of the optical system which, in the case of a lighting device of the elliptical type, is relatively small.

In order to make this apparent surface area bigger, it would then be necessary to increase the diameter of the convergent lens. However, in order to maintain a relatively limited lens thickness (and therefore weight), it is necessary to increase the focal distance of said lens.

In this case, the lighting device of the elliptical type with a convergent lens having a long focal length would then become very deep, which would make it difficult to fit in the bodywork of the vehicle.

OBJECTS OF THE INVENTION

Compared with the aforementioned state of the art, it is an object of the invention to provide a novel lighting device for an automobile, which offers good performance for the main-beam function, has an external appearance similar to that of a lighting device of the conventional elliptical type, and has an optimised size close to the size of a lighting device of the parabolic type, facilitating its fitting in the automobile.

SUMMARY OF THE INVENTION

According to one aspect, the present invention provides a lighting device for an automobile, comprising a light source, a reflector and a lens positioned in front of the reflector in order to form an illuminating light beam, said reflector being of the hyperbolic type with an internal focus and an external focus positioned behind said reflector in a region of the focus of said convergent lens, the light source being placed in a region of the internal focus of said reflector so that the latter forms a virtual light source in the region of the focus of said convergent lens.

Advantageously, the reflector of the hyperbolic type of the lighting device according to the invention forms a light flux recuperator and its convergent lens has dimensions at least equal to those of the front opening of said reflector in order to form an illuminating light beam of given intensity along the axis of said device. In particular, such a lighting device can form a standardised main-beam lighting beam.

According to other characteristics of the lighting device according to the invention, the convergent lens can be a plano-convex lens. The reflector can have roughly vertical serrations providing the horizontal spread of the illuminating light beam formed by the lighting device. This spread can also be achieved by means of the convergent lens, which can be a toric lens.

According to another aspect, the invention also proposes an optical unit for an automobile, which has a first lighting device fulfilling the function of dipped headlight or foglight, comprising a reflector of the elliptical type carrying a light source in the region of its internal focus, and a convergent lens whose focus is situated in a region of the external focus of said reflector, and a second lighting device fulfilling the main-beam function, the two lighting devices being disposed side by side, the second lighting device comprising a light source, a reflector and a lens positioned in front of the reflector in order to form an illuminating light beam, said reflector being of the hyperbolic type with an internal focus and an external focus positioned behind said reflector in a region of the focus of said convergent lens, the light source being placed in a region of the internal focus of said reflector so that the latter forms a virtual light source in the region of the focus of said convergent lens.

In this optical unit, the convergent lens of the second lighting device can advantageously be disposed adjacent to the convergent lens of the first lighting device.

BRIEF DESCRIPTION OF THE INVENTION

The description which follows with regard to the accompanying drawings, given by way of non-limitative examples, will give a clear understanding of what the invention consists of and how it can be represented.

In the accompanying drawings:

FIG. 1 depicts a partial schematic view in side section of the lighting device according to the invention, FIG. 2 depicts a partial schematic view in horizontal section of a variant embodiment of the lighting device according to the invention, and FIG. 3 depicts a horizontal schematic view of an optical unit according to the invention.

DESCRIPTION OF THE PREFERRED EMBODIMENTS

Figure 1:
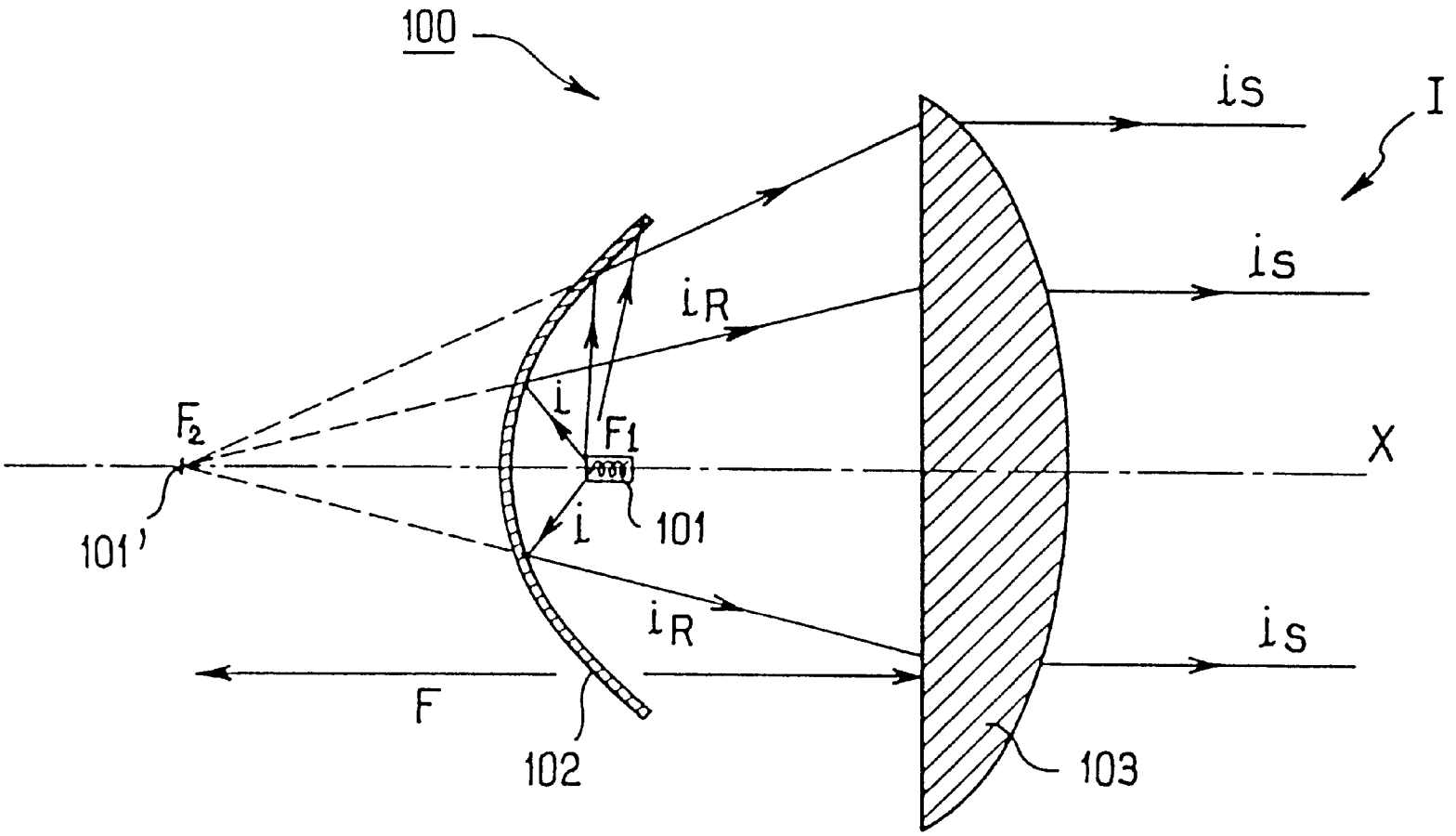

FIG. 1 depicts a lighting device 100 for an automobile, of axis X, and which comprises a substantially point source of light represented here by the filament of a lamp 101, a reflector 102 recuperating the light flux emitted by the light source 101, and a convergent lens 103 positioned in front of the reflector 102 in order to form an illuminating light beam I.

According to the embodiment depicted, the convergent lens 103 is a plano-convex lens with a convex front face, a plane rear face, and a given focal distance F.

The reflector 102 is of the hyperbolic type, that is to say it has a first internal focus $F_1$ closest to the reflector, situated in front between the reflector 102 and the convergent lens 103, and an external focus $F_2$ placed behind it. In this case, in FIG. 1 the reflector 102 consists of a portion of a hyperboloid. The reflector 102 and convergent lens 103 are arranged so that the second external focus $F_2$ of the reflector 102 is situated in a region of the object focal plane of the convergent lens 103, that is to say at the focal distance F of the said lens. Thus, the light source 101 being situated in a region of the internal focus $F_1$ of the reflector 102, the latter forms a virtual light source 101' which is an image of the real light source 101 in the region of its external focus $F_2$ situated in the region of the focus of the convergent lens 102.

The light rays i emitted by the real light source 101 in the direction of the reflector 102 are reflected by the latter in directions such that said reflected rays $i_r$ seem to come from the virtual light source 101' placed in the region of the external focus $F_2$ of the reflector (situated in the object focal plane of the lens), and the light rays $i_s$ coming from the convergent lens 103 are then substantially parallel to the axis of the latter.

The convergent lens 103 of the lighting device 100 has a similar appearance to a convergent lens of a lighting device of the elliptical type. Its dimensions are at least equal to those of the front opening of the reflector 102 in order to obtain an illuminating light beam of given intensity in the axis X of the lighting device. In particular, for a convex lens, its diameter is at least equal to that of the front opening of the reflector. In addition, the focal distance F of this convergent lens 103 is chosen so as to limit its thickness and thereby limit the total depth of the lighting device.

The diameter of the plano-convex convergent lens 103 can lie between approximately 60 and 120 mm, here 90 mm, its thickness can be limited to 5 to 30 mm, here approximately 10 mm, which gives a focal distance for the lens of approximately 206 mm for a convergent lens of the plano-convex type produced from a material of index 1.5. The depth of the lighting device according to the invention is between approximately 70 and 100 mm, here around 70 mm (the distance from the apex of the reflector to the lens) and the distance between the internal focus and the apex of the reflector is between approximately 7 and 15 mm, here around 8 mm.

It can be seen here that, compared with a lighting device with a reflector of the elliptical type where the focus of the lens is situated in front of the internal focus of the reflector in a region of its external focus, in the lighting device according to the invention with a reflector of the hyperbolic type, there is a gain in depth of more than 136 mm (the distance between the apex of the reflector of the hyperbolic type and the external focus of said reflector where the focus of the lens is situated).

According to another embodiment, not shown, of the lighting device, provision can be made for the convergent lens to be a toric lens so as to provide a certain horizontal spread of the light beam formed. Provision can also be made for the reflector to be serrated in a roughly vertical direction in order to obtain the horizontal spread of said illuminating light beam formed by the lighting device.

Figure 2:
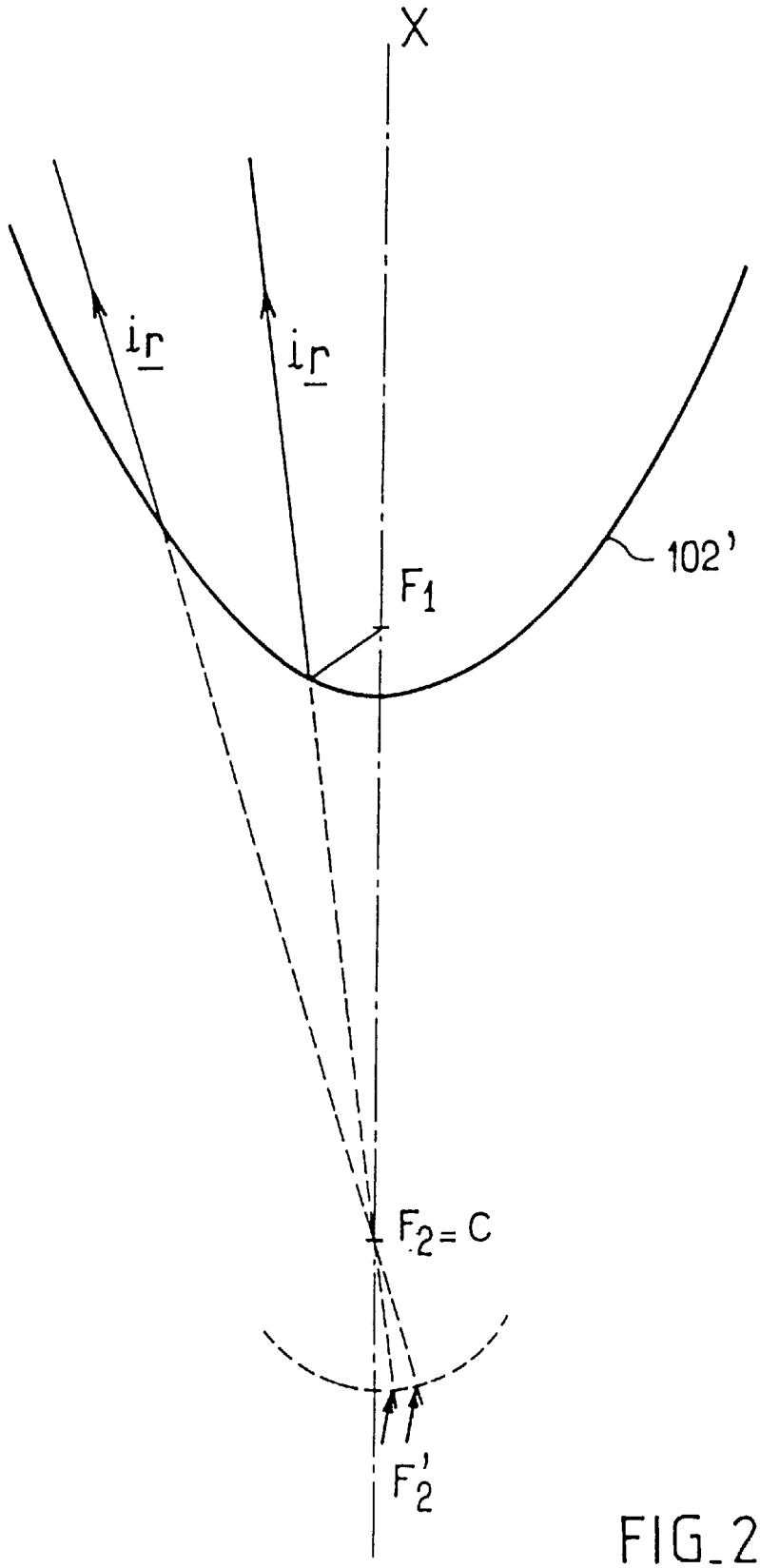

According to a variant depicted in FIG. 2, in order to spread in width the light beam emitted by the lighting device according to the invention, provision can be made for the reflector to be shaped so that it has a hyperbolic horizontal section 102' (depicted in FIG. 2) containing the optical axis X of said lighting device. This hyperbolic horizontal section 102' has an internal focus $F_1$, and an external focus $F_2$ situated behind the reflector. The reflector has vertical sections containing at least one light ray $i_r$ reflected by the hyperbolic horizontal section, which follow hyperbolae, each of these hyperbolae having an internal focus corresponding to the internal focus $F_1$ of said hyperbolic horizontal section 102' and an external focus $F_2$ situated behind the external focus $F_2$' of said hyperbolic horizontal section 102'. All the external foci $F_2$' of the different hyperbolic vertical sections of said reflector are situated on a portion of a circle whose centre C is positioned in a region of the external focus $F_2$ of the hyperbolic horizontal section of the reflector.

Advantageously, the lighting device according to the invention can satisfactory fulfil the main-beam function by forming a main-beam lighting beam in accordance with the current standards whilst having the external appearance of a lighting device of the elliptical type which generally fulfils the dipped-beam function.

Figure 3:
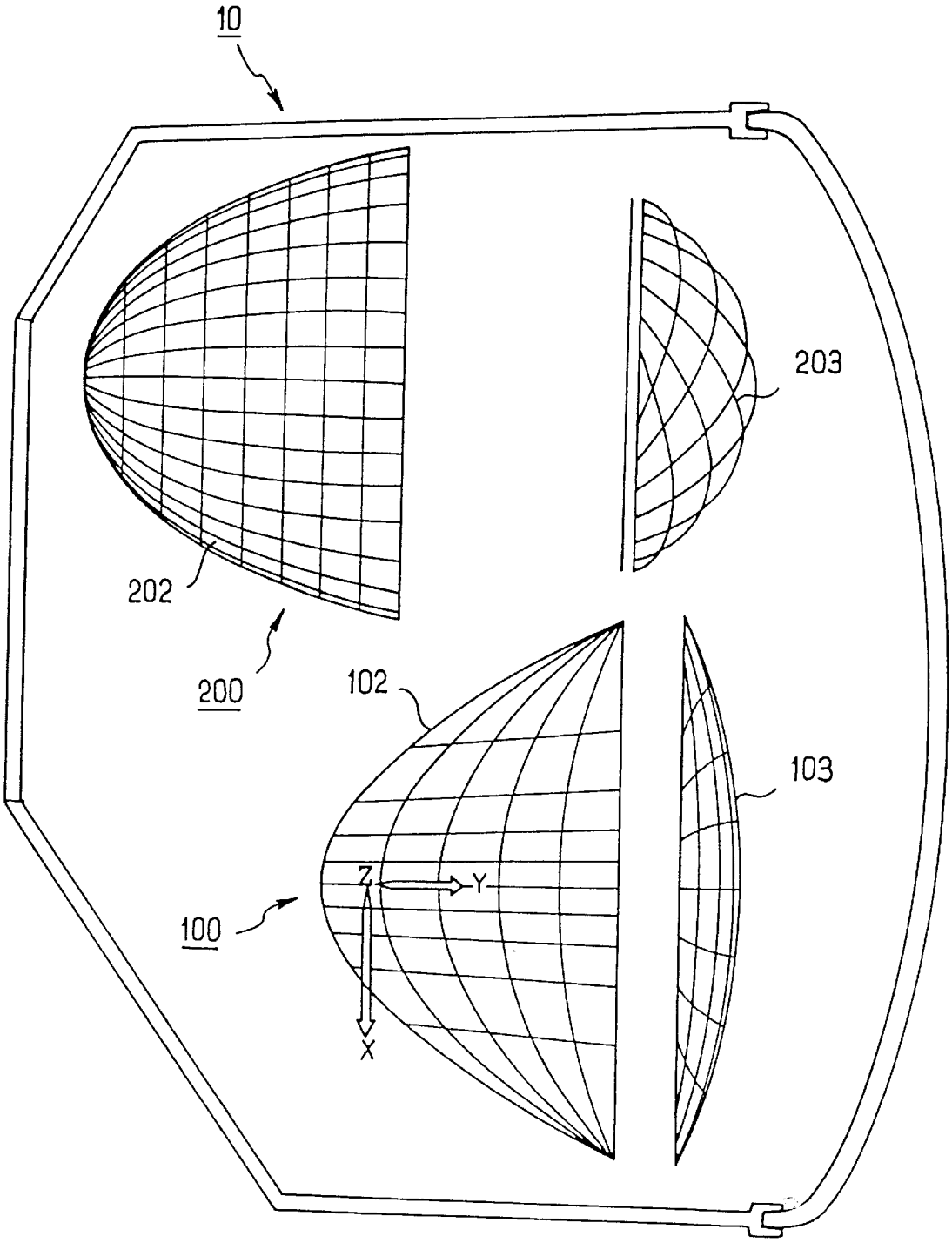

In this regard, according to the invention, there is proposed, as show in FIG. 3, an optical unit 10 which has two lighting devices 200, 100 positioned side by side, the first lighting device 200 here fulfilling the dipped-beam function and having, in a known fashion, a reflector 202 of the elliptical type carrying, in a region of its first internal focus, the light source so that the rays reflected by said elliptical reflector 202 converge in a region of its second external focus where there is situated the object focal plane of the convergent lens 203 positioned in front of the reflector.

The second lighting device fulfilling the main-beam function is of the same type as the lighting device 100 depicted in FIG. 1, with a reflector of the hyperbolic type 102 disposed in the vicinity of the reflector of the elliptical type 10.

The two convergent lenses 203, 103 used for the first and second lighting device 200, 100 naturally have a similar appearance and are advantageously positioned adjacent in order to obtain an optical unit which externally has harmony of style.

The invention is of course not limited to the embodiments described and depicted, but a person skilled in the art will know how to make any variation thereto in accordance with its spirit.

What is claimed is:

1. A lighting device for an automobile comprising a light source, a reflector associated with the light source, and a covergent lens positioned in front of the reflector and the light source in order to form an illuminating light beam, said reflector being of a hyperbolic type with an internal focus and an external focus positioned behind said reflector in a region of the focus of said convergent lens, the light source being placed in a region of the internal focus of said reflector so that the latter forms a virtual light source in the region of the focus of said convergent lens.

2. The lighting device of claim 1, wherein the convergent lens has dimensions at least equal to those of the front opening of said reflector.

3. The lighting device of claim 1, wherein the convergent lens is a plano-convex lens.

4. The lighting device of claim 1, wherein the convergent lens is a toric lens.

5. The lighting device of claim 1, wherein the reflector has roughly vertical serrations providing the horizontal spread of the illuminating light beam issuing from the lighting device.

6. A lighting device for an automobile comprising a light source, a reflector associated with the light source, and a covergent lens positioned in front of the reflector and the light source in order to form an illuminating light beam, said reflector being of a hyperbolic type with an internal focus, and an external focus positioned behind said reflector in a region of the focus of said convergent lens, the light source being placed in a region of the internal focus of said reflector so that the latter forms a virtual light source in the region of the focus of said convergent lens wherein the reflector is configured so that it has a hyperbolic horizontal section containing the optical axis of said lighting device, with an internal focus and an external focus situated behind the reflector, and each vertical section containing at least one light ray reflected by said hyperbolic horizontal section, which follows a hyperbola whose internal focus corresponds to the internal focus of said hyperbolic horizontal section, and whose external focus is situated behind the external focus of said hyperbolic horizontal section, all the external foci of the different hyperbolic vertical sections of said reflector being situated on a portion of a circle whose centre is positioned in a region of the external focus of said hyperbolic horizontal section.

7. The lighting device of claim 6, wherein the convergent lens has dimensions at least equal to those of the front opening of said reflector.

8. The lighting device of claim 6, wherein the convergent lens is a plano-convex lens.

9. The lighting device of claim 6, wherein the convergent lens is a toric lens.

10. The lighting device of claim 6, wherein the reflector has roughly vertical serrations providing the horizontal spread of the illuminating light beam issuing from the lighting device.

11. An optical unit for an automobile, which has a first lighting device fulfilling the function of dipped headlight or foglight, comprising a reflector of the elliptical type carrying a light source in the region of its internal focus, and a convergent lens whose focus is situated in a region of the external focus of said reflector, and a second lighting device fulfilling the main-beam function, the two lighting devices being disposed side by side, the second lighting device comprising a light source, a reflector associated with the light source, and a covergent lens positioned in front of the reflector and the light source in order to form an illuminating light beam, said reflector being of a hyperbolic type with an internal focus, and an external focus positioned behind said reflector in a region of the focus of said convergent lens, the light source being placed in a region of the internal focus of said reflector so that the latter forms a virtual light source in the region of the focus of said convergent lens.

12. The optical unit of claim 11, wherein the convergent lens of the second lighting device is positioned adjacent to the convergent lens of the first lighting device.

13. The lighting device according to claim 3 wherein the plano-convex lens has a diameter in the range of 60–120 mm.

14. The lighting device according to claim 3 wherein the plano-convex lens has a diameter of approximately 90 mm.

15. The lighting device according to claim 3 wherein the plano-convex lens has a thickness in the range of 5–30 mm.

16. The lighting device according to claim 3 wherein the plano-convex lens has a thickness of approximately 10 mm.

17. The lighting device according to claim 3 wherein the depth of the lighting device as measured from an apex of the reflector to the lens is in the range of 70–100 mm.

18. The lighting device according to claim 3 wherein the depth of the lighting device as measured from an apex of the reflector to the lens is approximately 70 mm.

* * * * *